US006371141B1

(12) United States Patent
Lin et al.

(10) Patent No.: US 6,371,141 B1
(45) Date of Patent: Apr. 16, 2002

(54) SAFETY UMBRELLA RUNNER ERGONOMICALLY OPERATED BY SLIDING PUSH BUTTON

(75) Inventors: Chung-Kuang Lin; Jung-Jen Chang, both of Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 09/568,160

(22) Filed: May 10, 2000

(51) Int. Cl.[7] ..... A45B 25/06
(52) U.S. Cl. ..... 135/28; 135/39; 135/41
(58) Field of Search ..... 135/28, 37, 38, 135/39, 40, 41, 15.1, 20.3

(56) References Cited

U.S. PATENT DOCUMENTS 196,586 A * 10/1877 Knapp ..... 135/28
5,357,994 A * 10/1994 Chung ..... 135/28 X
5,398,709 A * 3/1995 Lee ..... 135/28
5,566,699 A * 10/1996 Kou ..... 135/28
5,732,725 A * 3/1998 Ko ..... 135/28
5,740,824 A * 4/1998 Tang ..... 135/28
6,006,771 A * 12/1999 Wu ..... 135/41
6,192,907 B1 * 2/2001 Wu ..... 135/28

* cited by examiner

*Primary Examiner*—Carl D. Friedman
*Assistant Examiner*—Winnie Yip
(74) *Attorney, Agent, or Firm*—Troxell Law Offices PLLC

(57) ABSTRACT

A safety umbrella runner includes: a push button having a plunger slidably held in a slot transversely formed through the runner to contact a spring catch normally resiliently protruding outwardly from the central shaft for retaining the runner when opening the umbrella, with the push button stably slidably held in the slot formed in the runner for a very ergonomic operation when depressing the push button for disengaging the runner from the catch for closing the umbrella.

6 Claims, 4 Drawing Sheets

SAFETY UMBRELLA RUNNER ERGONOMICALLY OPERATED BY SLIDING PUSH BUTTON

BACKGROUND OF THE INVENTION

U.S. Pat No. 5,732,725 to Ko disclosed a safety runner used in umbrella having a tab T integrally formed to a base B of the runner R as illustrated in FIG. 1, whereby upon depression of the tab T to retract the catch C, which is resiliently protruded from the central shaft S for retaining the runner R at opening state, the runner may be lowered to close the umbrella without touching the acute catch C for safety.

However, when the umbrella user depress the tab T at the point P1 near the hinge point F where the tab T is integrally secured to the base B of the runner R, it will require a greater force for depressing the tab for closing the umbrella with a shorter arm of force between point P1 and the point F.

For obtaining a longer arm of force, it is preferable to depress the tab at a lower point, P2. However, a raised pad T1 should be formed on an inside surface of the tab T in order to contact the catch C, causing production complexity for the tab T and the runner R.

Moreover, the repeated depression and biasing movements of the tab T at the turning point or hinge point F may cause breakage of the tab from the runner, loosing the safety effect by the tab.

The present inventor has found the drawbacks of the conventional safety runner and invented the present safety umbrella runner as effected by a sliding push button.

SUMMARY OF THE INVENTION

The object of the present invention is to provide a safety umbrella runner including: a push button having a plunger slidably held in a primary slot transversely formed through the runner to be generally perpendicular to a longitudinal axis defined at a longitudinal center of the central shaft of the umbrella and having an inside surface of the push button contacting a spring catch normally resiliently protruding outwardly from the central shaft for retaining the runner when opening the umbrella, and having a pair of lugs symmetrically disposed on opposite side portions of the plunger and respectively slidably engaging with a pair of secondary slots symmetrically recessed in opposite side walls of the primary slot with each secondary slot generally perpendicular to the longitudinal axis of the central shaft, with the push button stably slidably held in the primary and secondary slots formed in the runner for a very ergonomic operation when depressing the push button for disengaging the runner from the catch for closing the umbrella.

DETAILED DESCRIPTION

Figure 1:
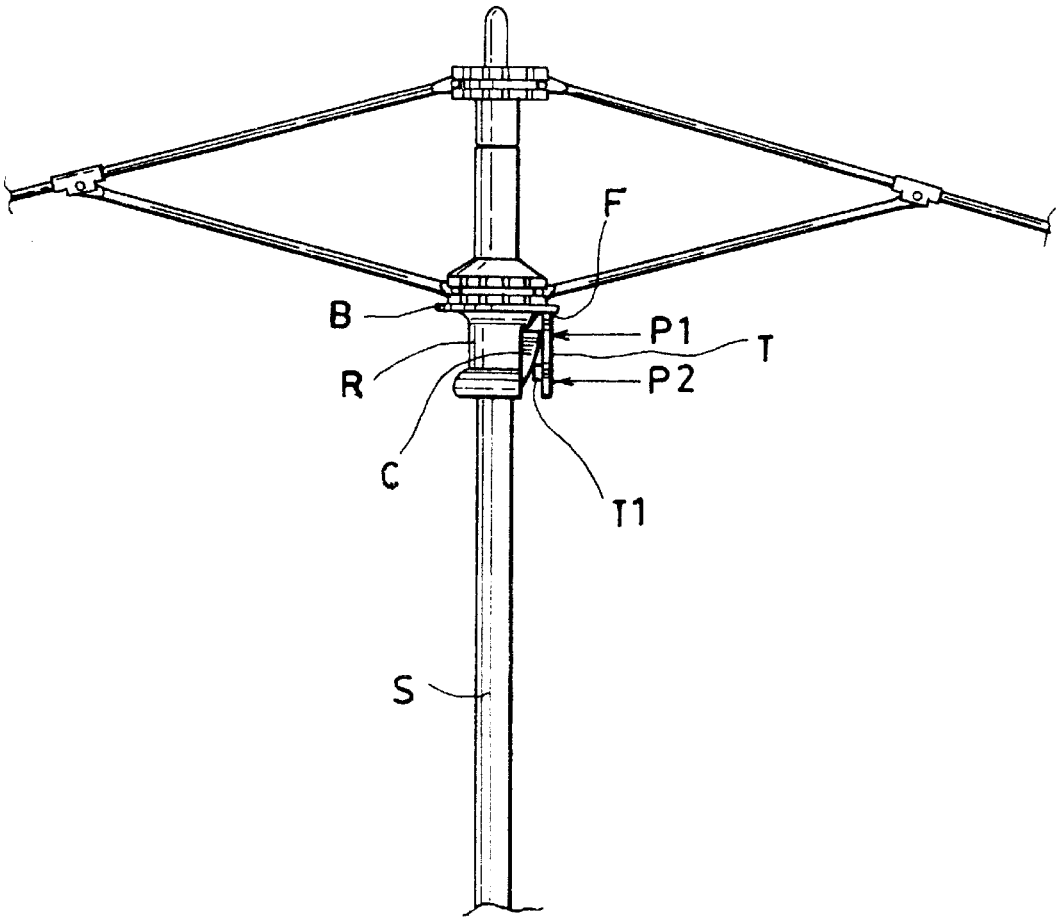
FIG.1 PRIOR ART
FIG. 1 shows a prior art of safety runner.

As shown in FIGS. 2~6, the safety umbrella runner 3 of the present invention comprises: a sleeve 31 having a central hole 30 slidably engageable with a central shaft 1, a ferrule 32 integrally formed on a middle portion of the sleeve 31 for pivotally securing a stretcher rib 22 of a rib assembly 2 having a top rib 21 pivotally connected between the stretcher rib 21 ad an upper notch 20 formed on a top 10 of the central shaft 1, a primary slot 33 transversely formed through a lower portion of the runner along a latitudinal axis Y defined at a center of the primary slot 33 with the latitudinal axis Y being perpendicular to a longitudinal axis X defined at a longitudinal center of the central shaft 1 (FIG. 3), a retarding shoulder portion 34 formed at an inner portion of the primary slot 33 adjacent the central hole 30 of the sleeve 31 for engaging a protrusion 51 formed on an upper portion of a spring catch 5 secured in the central shaft 1 and resiliently protruding outwardly through a slit 11 cut in the shaft 1 for retaining the runner 3 when opening the umbrella (FIGS. 2~4), a pair of secondary slots 35 symmetrically recessed (or formed) in opposite side walls of the primary slot 33 with each secondary slot 35 being formed at a middle or waist portion of each side wall of the primary slot and generally perpendicular to the longitudinal axis X of the central shaft 1, and a sliding push button 4 slidably held in the primary and secondary slots 33, 35.

Each secondary slot 35 includes a stopping end wall 36 formed at an outer end portion of the secondary slot 35. Each slot 35 may also be formed through a thickness of the runner 3.

Figure 5:
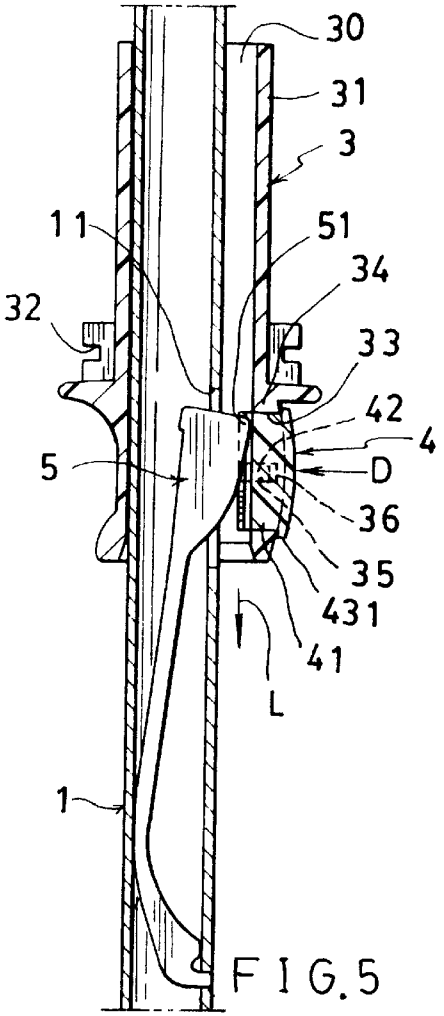
FIG. 5 is a sectional drawing of the present invention when closing the umbrella.

The sliding push button 4 includes: a plunger 41 slidably engageable with the primary slot 33 formed in the runner 3, a pair of lugs 42 symmetrically formed on opposite side walls of the plunger 41 to be respectively slidably engageable with the pair of secondary slots 35 in the primary slot 33, and a button plate 43 formed on an outer portion of the plunger 41 having an extension 431 circumferentially disposed on an edge portion of the button plate 43; whereby upon an inward depression on the push button 4, the extension 431 of the button plate 43 will be retarded against an outer end wall of the primary slot 33 as shown in FIG. 5 when closing the umbrella by pushing the button 4 inwardly (D) for thrusting the protrusion 51 of the spring catch 5 retractably into the central hole 30 of the runner 3 to disengage the protrusion 51 of the catch 5 from the retarding shoulder portion 34 of the runner 3, allowing a lowering (L) of the runner 3 for closing the umbrella (FIG. 5).

Figures 2, 3:
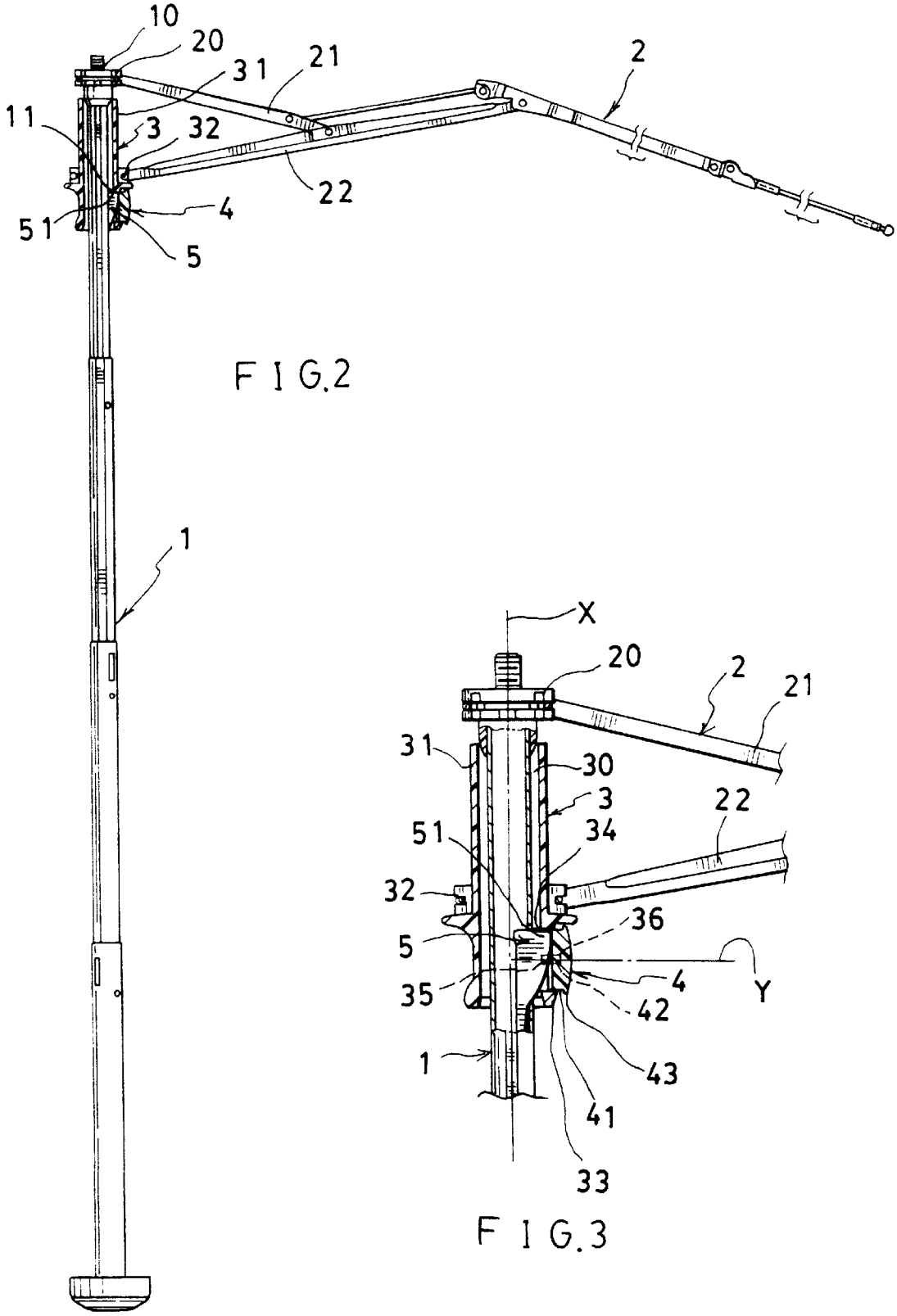
FIG. 2 is an illustration of the present invention when opening the umbrella.
FIG. 3 is a partially enlarged illustration of the present invention from FIG. 2.
Figure 6:
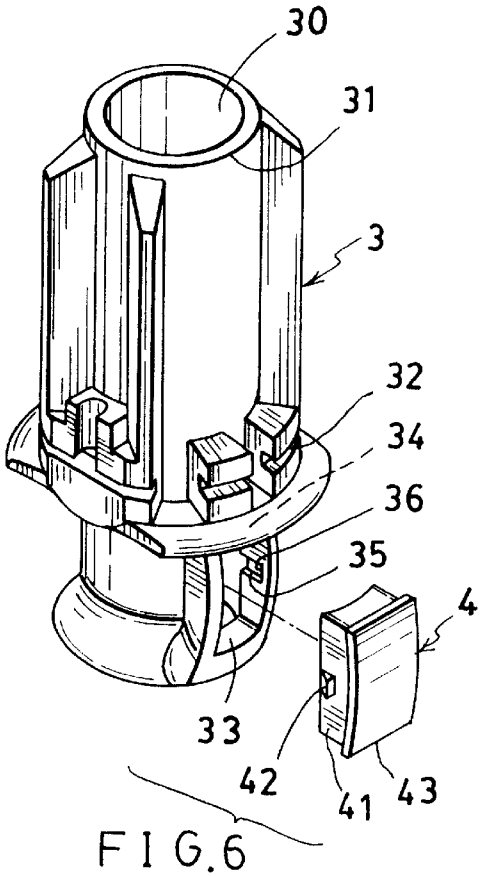
FIG. 6 is a perspective exploded view of the present invention.
Figure 4:
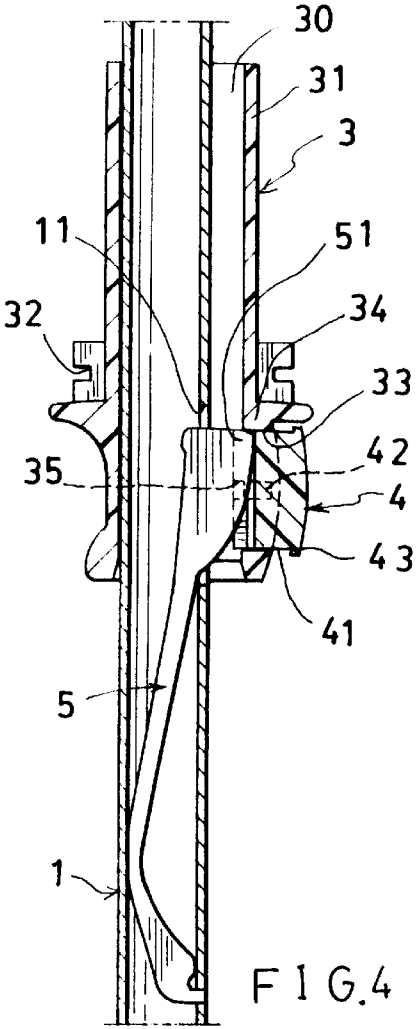
FIG. 4 is a sectional drawing of the present invention when opening the umbrella.

When opening the umbrella as shown in FIGS. 2~4, the protrusion 51 of the spring catch 5 is protruded outwardly to urge the push button 4 outwardly until each lug 42 on the plunger 41 of the button 4 is limited by the stopping end wall 36 formed on an outer end portion of each secondary slot 35 without releasing the button 4 from the slot 33 of the runner 3 and the catch 5 will retain the runner 3 for opening the umbrella (FIG. 2).

When closing the umbrella, the push button 4 is depressed inwardly (D) as shown in FIG. 5 to push the protrusion 51 of the catch 5 inwardly to be disengaged from the shoulder portion 34 of the runner 3, whereby the runner 3 is no longer retarded by the catch 5 and can be lowered (L) to close the umbrella.

The plunger 41 of the push button 4 has a suitable length (or depth) to be slidably engageable in the slot 33, and the two lugs 42 on the plunger 41 of the button 4 are slidably engageable within the secondary slots 35, thereby helping a stable sliding movement of the push button 4 within and along both the primary slot 33 and the secondary slots 35. Even upon depression on any location or "spot" on the button surface of the push button 4, the depression force on the button 4 will inwardly thrust the button 4 straightforwardly in the slots 33, 35 since the plunger 41 and the two lugs 42 of the button 4 are stably guided in the slots 33, 35 without being twisted or inclinedly biased, thereby enforcing a reliable ergonomic operation for depressing the push button 4 and for closing the umbrella.

The present invention is superior to the prior art of U.S. Pat. No. 5,732,725 with the following advantages:

1. The push button 4 can be straightforwardly depressed to inwardly thrust the catch with a light force and in an ergonomic way, without the need for carefully selecting a depression "spot" (location) for depressing the tab with light force as found in U.S. Pat. No. 5,732,725.
2. The push button 4 is slidably held in the runner 4, not integrally secured to the runner, thereby preventing the breakage of button as hingedly secured to the runner as found in U.S. Pat. No. 5,732,725.

As shown in the drawing figures, the slot 33 or 35 has a cross section of rectangular shape. However, other shapes such as circular or elliptic shape may also be used in this invention. Each lug 42 is formed on a middle (or waist) portion of the plunger of the button 4.

Figure 9:
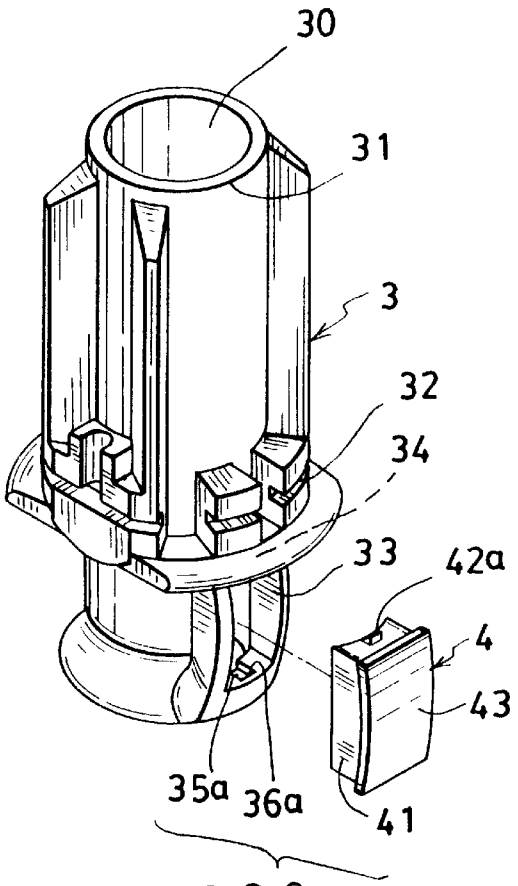
FIG. 9 is a perspective exploded view of the present invention of FIG. 7.
Figure 8:
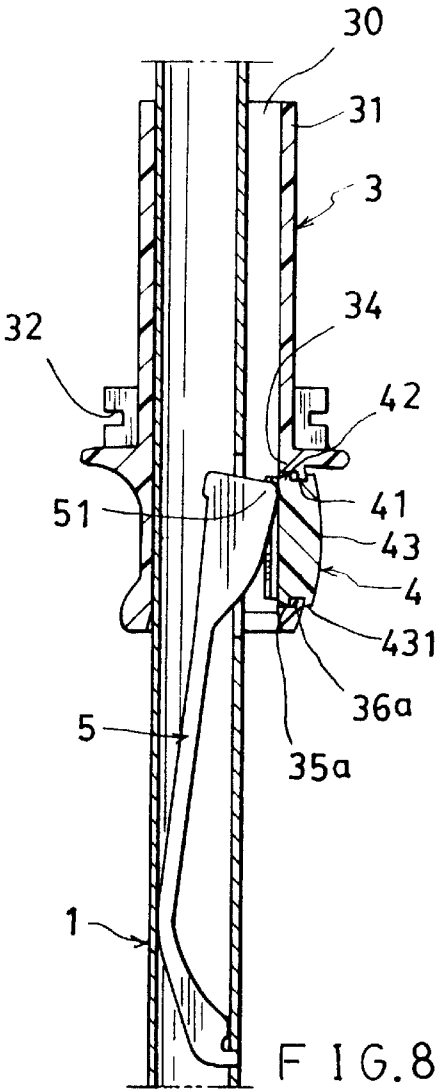
FIG. 8 shows the present invention when closing the umbrella from FIG. 7.
Figure 7:
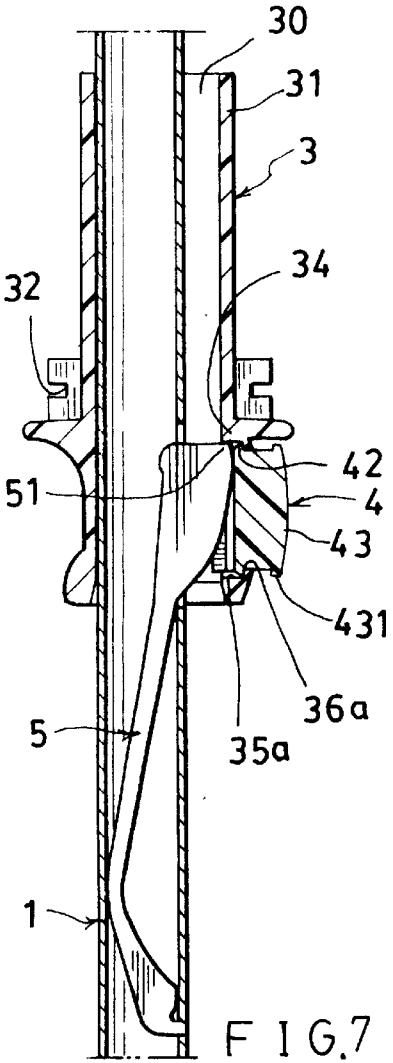
FIG. 7 shows another preferred embodiment of the present invention when opening the umbrella.

As shown in FIGS. 7~9, the push button 4 of the present invention may be modified to form the pair of lugs 42*a* on opposite side walls, namely, an upper side wall and a lower side wall of the plunger 41 to be slidably engageable with the two secondary slots 35*a* symmetrically recessed in an upper side wall and a lower side wall of the primary slot 33 in the runner 3. Each secondary slot 35*a* has a stopping end wall 36*a* on an outer end portion of the slot 35*a* for limiting an outward releasing of the lug 42 of the button 4 from the slot 35*a* of the runner 3.

The present invention may be modified without departing from the spirit and scope of this invention.

We claim:

1. A safety umbrella runner comprising:

a sleeve slidably engaged with a central shaft defining a longitudinal axis at a longitudinal center of said shaft; a ferrule integrally formed on said sleeve for pivotally securing a stretcher rib of a rib assembly on said ferrule; a retarding shoulder portion formed in said sleeve for engaging a protrusion of a spring catch resiliently fixed in the central shaft for retaining the runner when opening an umbrella;

the improvement which comprises:

a sliding push button including a plunger slidably engaged with a primary slot transversely formed through said runner, said primary slot formed in said runner defining a latitudinal axis at a center of said primary slot to be perpendicular to said longitudinal axis in said central shaft, said push button having an inside surface operatively contacted with said protrusion of said spring catch; whereby upon an inward depression of said push button to thrust said protrusion of said catch inwardly to disengage the retarding shoulder portion of said runner from said protrusion of said catch, said runner is not retarded by the catch and is lowered to close the umbrella; and said sliding push button including a pair of lugs symmetrically formed on opposite side walls of said plunger, said two lugs respectively slidably engaged with two secondary slots symmetrically formed in opposite side walls of said primary slot in said runner, and each said secondary slot being generally perpendicular to said longitudinal axis of said central shaft.

2. A safety umbrella runner according to claim 1, wherein said two lugs of said push button are symmetrically formed on opposite side walls of said plunger of said push button, each said lug formed on a middle or waist portion of each said side wall of said plunger, each said lug slidably engaged with each said secondary slot transversely formed in a middle or waist portion of each side wall of said primary slot.

3. A safety umbrella runner according to claim 1, wherein said two lugs of said push button are symmetrically formed on an upper side wall and a lower side wall of said plunger of said push button, two said lugs respectively slidably engaged with two said secondary slots respectively transversely formed in an upper side wall and a lower side wall of said primary slot in said runner.

4. A safety umbrella runner according to claim 1, wherein each said secondary slot includes a stopping end wall formed on an outer end portion of each said secondary slot for limiting an outward movement of said lug of said push button.

5. A safety umbrella runner according to claim 1, wherein said sliding push button includes a button plate formed on an outer portion of said plunger, having an extension circumferentially formed on an edge portion of said button plate to be retarded on an outer end wall of said primary slot of said runner when inwardly depressing the push button.

6. A safety umbrella runner according to claim 1, wherein said plunger of said push button has a cross section selected from polygonal shapes including rectangular shape.

* * * * *